United States Patent [19]

Payraud

[11] Patent Number: 4,627,636

[45] Date of Patent: Dec. 9, 1986

[54] MONOSKI CONVERTER

[76] Inventor: Fernand Payraud, "Le Clos Baron" Domancy, 74700 Sallanches, France

[21] Appl. No.: 721,598

[22] Filed: Apr. 10, 1985

[30] Foreign Application Priority Data

Apr. 10, 1984 [FR] France ..... 84 05861

[51] Int. Cl.[4] ..... A63C 11/00

[52] U.S. Cl. ..... 280/607; 280/818

[58] Field of Search ..... 280/607, 12 F, 818, 280/817, 815, 814, 613; 441/73

[56] References Cited

U.S. PATENT DOCUMENTS

| | | | |
|---|---|---|---|
| 3,066,328 | 12/1962 | Jones | 280/818 |
| 3,862,764 | 1/1975 | Hartz | 280/818 |
| 3,907,320 | 9/1975 | Charneck | 280/818 |
| 4,234,113 | 11/1980 | Nalvarian | 280/814 |
| 4,427,217 | 1/1984 | Savzay | 280/814 |

FOREIGN PATENT DOCUMENTS

| | | | |
|---|---|---|---|
| 180719 | 5/1936 | Switzerland | 280/12 F |

OTHER PUBLICATIONS

Article entitled "Twin Ski".

*Primary Examiner*—John J. Love
*Assistant Examiner*—Michael Mar
*Attorney, Agent, or Firm*—Karl F. Ross; Herbert Dubno

[57] ABSTRACT

A monoski converter is used in combination with a standard pair of skis and ski boots and has a longitudinal stem having front and rear ends respectively formed with transversely projecting rear tabs. The tabs and stem form a pair of like parallel seats that extend longitudinally and that are dimensioned to fit over the respective skis with the rear tabs between the respective toe and heel clamps. The ski boots are fitted to the clamps of the respective skis with the respective rear tabs held tightly between the boots and the skis so that the two skis are locked together into a monoski. The converter is substantially symmetrical about a longitudinal central plane extending along the stem and is unitarily molded of a synthetic resin. The tabs have longitudinal outer edges formed with longitudinal and downwardly projecting ribs delimiting the respective seats. Furthermore, the converter is substantially thicker at the stem than at the tabs and the stem projects downward past the tabs and has longitudinal side edges confronting the respective ribs and also delimiting the respective seats.

13 Claims, 7 Drawing Figures

MONOSKI CONVERTER

FIELD OF THE INVENTION

The present invention relates to skis. More particularly this invention concerns a device for converting a conventional pair of skis into a monoski.

BACKGROUND OF THE INVENTION

A standard pair of skis comprises two independent skis each provided with a toe clamp and a heel clamp. The user's ski boots are fitted to the clamps of the respective skis for normal dual-ski use, either for downhill or cross-country skiing. Such skis are useful for rapid maneuvering and for skiing on tricky or very hard surfaces.

A monoski basically operates like a surfboard, but with both of the user's feet locked in place to a single fairly broad monoski board. Such style of skiing is considered a nice change of pace and is particularly easy for the novice. In addition it provides sufficient support in powdery snow for good speed.

Such a monoski is, however, a fairly expensive item, as it must have a set of bindings like standard skis. In addition it is quite bulky, even more than standard dual skis. There are also certain slopes or lift equipment where a monoski is not usable or permitted, and it is virtually impossible, for instance, to climb a slope with a monoski.

OBJECTS OF THE INVENTION

It is therefore an object of the present invention to provide an improved monoski-type piece of sporting equipment.

Another object is the provision of such a monoski-type piece of sporting equipment which overcomes the above-given disadvantages, that is which is fairly simple and inexpensive.

SUMMARY OF THE INVENTION

These objects are attained according to this invention by a monoski converter usable in combination with a standard pair of skis and ski boots and having a longitudinal stem having front and rear ends respectively formed with transversely projecting rear tabs. The tabs and stem form a pair of like parallel seats that extend longitudinally and that are dimensioned to fit over the respective skis with the rear tabs between the respective toe and heel clamps. The ski boots are fitted to the clamps of the respective skis with the respective rear tabs held tightly between the boots and the skis so that the two skis are locked together into a monoski.

Thus according to the instant invention a fairly simple adapter is provided which can be fitted to a standard pair of skis to convert them into a monoski. The converter has no moving parts and itself is much shorter than the skis it connects, so that it can be made at low cost and transported readily. Indeed, the system of this invention can be carried by the user during a day's ski outing and can be fitted to his or her skis rapidly, in the open, for conversion to a monoski. The system therefore leaves the user the option of dual skis or a monoski, making this latter style of skiing accessible to virtually any skier at little cost. The expensive bindings already provided on the user's skis serve the function of holding the converter in place between the soles of the ski boots and the upper ski surfaces.

According to another feature of this invention the converter is substantially symmetrical about a longitudinal central plane extending along the stem. The converter is unitarily molded of a synthetic resin and the tabs have longitudinal outer edges formed with longitudinal and downwardly projecting ribs delimiting the respective seats. Furthermore, the converter is substantially thicker at the stem than at the tabs and the stem projects downward past the tabs and has longitudinal side edges confronting the respective ribs and also delimiting the respective seats.

Spacers can be releasably secured to the longitudinal side edges and transversely engage the respective skis. Thus skis of different width can be fitted tightly in the seats with the help of the spacers. The side edges of the stem are formed with holes and the spacers have lugs snugly fitting therein to secure these spacers in place. Similarly, spacer blocks are secured to the rear tabs and held thereagainst by the respective ski boot. Such spacer blocks can be secured by a pressure-sensitive adhesive to the top surfaces of the respective rear tabs, and can have high-friction upper surfaces to ensure good clamping of the converter between the ski boots and the skis.

The converter is formed ahead of each rear tab with a transversely projecting front tab forming with the respective rear tab a laterally open cutout. The toe clamp is engaged in the cutout. In this manner the seats are fairly long for solid interconnection of the two skis.

The front end of the stem according to the invention is turned up like a ski, so that in effect the flat stem fills in between the skis and augments the support surface afforded by the thus formed monoski to which end the lower stem surface is smooth. Each such front tab is formed with a rearwardly and longitudinally open notch snugly receiving the respective toe clamp, thereby insuring a solid connection of the two skis together.

In addition the converter is provided with a lanyard which is connected to one of the ski bindings when the converter is in use, so it is not lost if the skier falls and the bindings release, and which is used to carry the device, for example looped over a shoulder, when not in use. The rear end of the stem is provided with an eye to which the lanyard is attached.

Skiing with the monoski attachment locked in place between a pair of skis has all of the usual advantages of the monoski, mainly in that the large surface area permits good travel over very powdery snow. In addition the spring action of the forwardly and rearwardly extending ski ends allows these parts to be deflected independently of one another for particularly good response to terrain.

DESCRIPTION OF THE DRAWING

The above and other features and advantages will become more readily apparent from the following, reference being made to the accompanying drawing in which.

SPECIFIC DESCRIPTION

Figure 1:
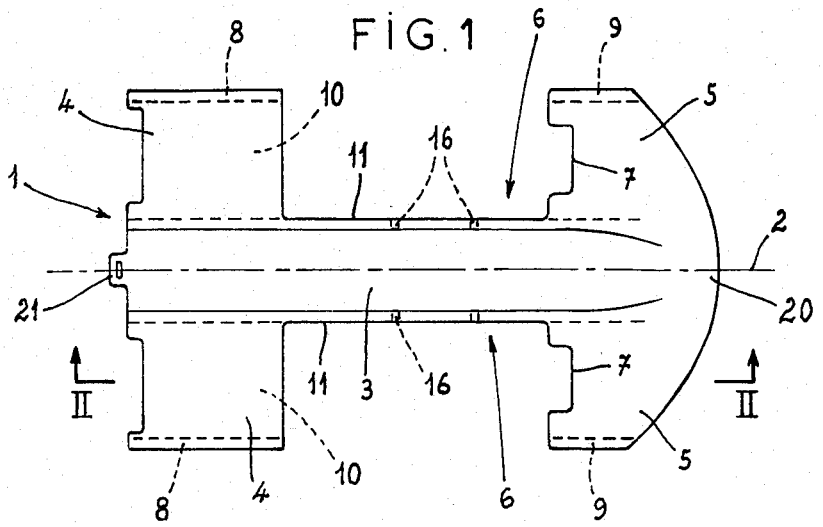
FIG. 1 is a top view of the ski converter according to this invention.
Figure 2:
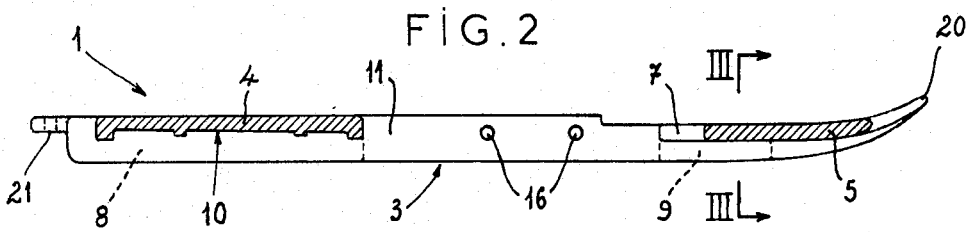
FIG. 2 is a section taken along line II—II of FIG. 1.
Figure 3:
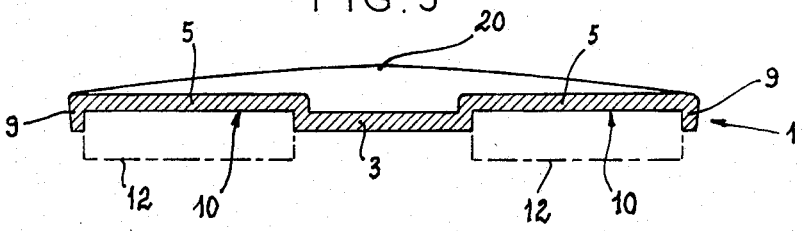
FIG. 3 is a section taken along line III—III of FIG. 2.

As seen in FIGS. 1 through 3, a ski converter 1 according to the invention extends along and is symmetrical about a longitudinal axis 2. It has a central longitudinally extending stem 3, a pair of rear and symmetrically opposite heel tabs 4, and a pair of front and symmetrically opposite toe tabs or wings 5, all formed integrally of a durable synthetic resin. This structure forms a pair of identical generally rectangular cutouts 6 and the transverse rear edges of the front tabs 5 are formed with longitudinally backwardly open notches 7.

As best seen in FIGS. 2 and 3, the stem 3 projects down below the tabs 4 and 5, which themselves are formed on their longitudinal outer edges with respective downwardly projecting ribs 8 and 9. The effect is to form two identical longitudinally and downwardly open seats 10 each having an outer side delimited by the respective ribs 8 and 9 and an inner side delimited by the respective longitudinal edge 11 of the stem 3.

Figure 5:
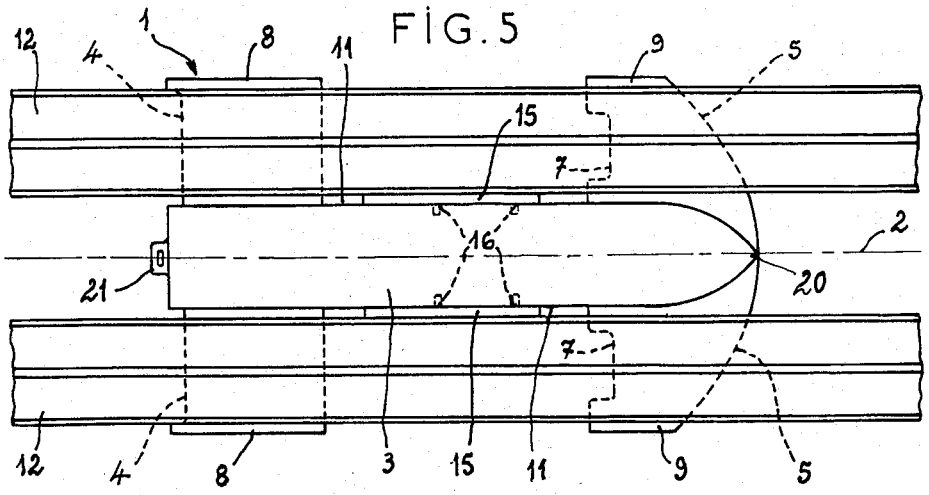
FIG. 5 is a top view of the converter mounted on the skis.
Figure 4:
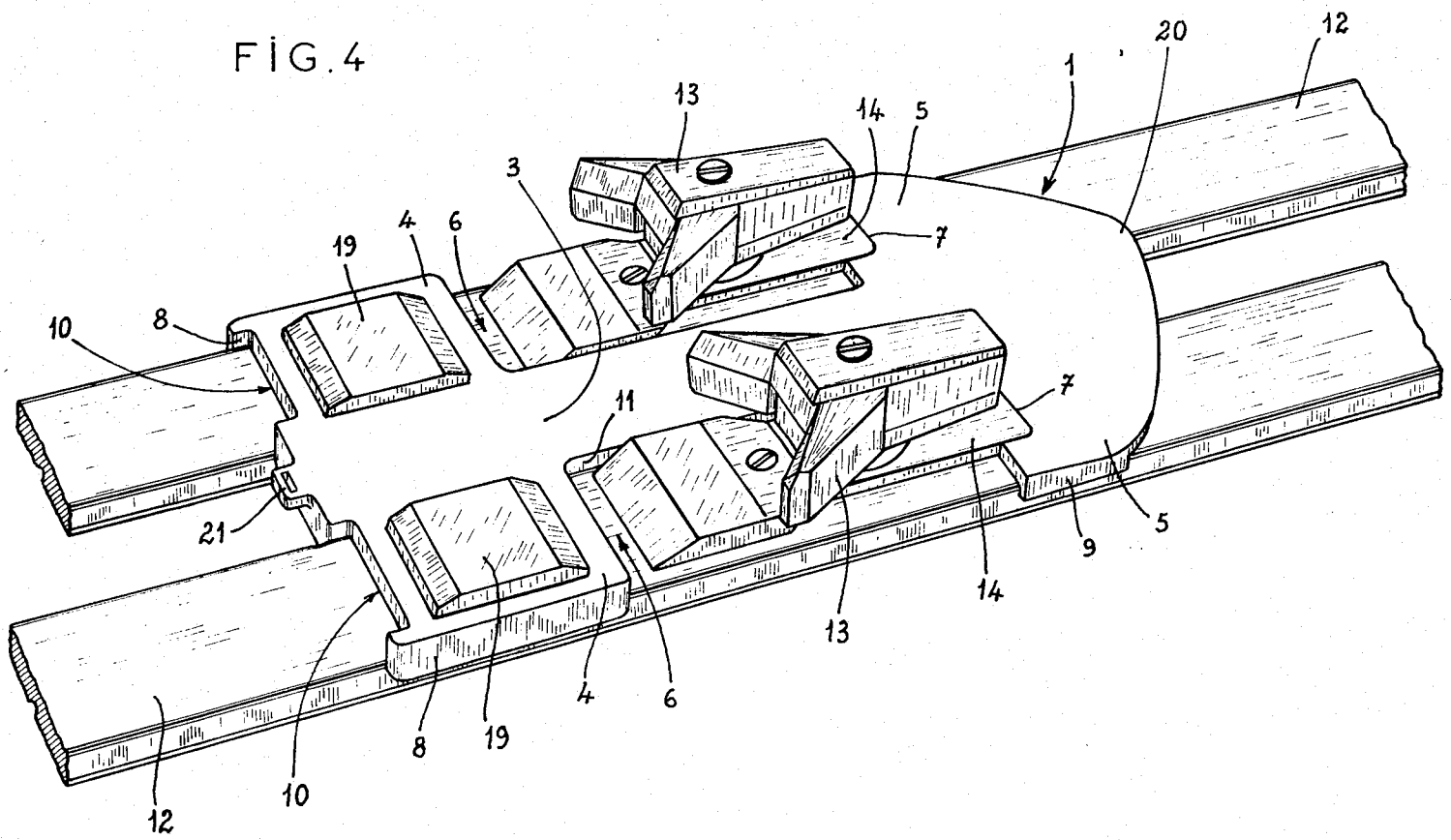
FIG. 4 is a perspective view showing the converter mounted on a pair of skis.

FIGS. 4 and 5 show how these seats 10 are dimensioned to fit over standard skis 12. In practice it has been found that only three different sizes of converters 1 can accommodate the entire range of ski sizes. If the seats 10 are too wide, spacers 15 can be mounted on the stem edges 11 by fitting lugs on these spacers 15 into appropriate bores 16 in these edges 11 so that the outer longitudinal edges of the skis are snug against the ribs 8 and 9. The converter 1 is set atop the skis 12, which are spaced apart by the transverse width of the stem 3, with the tabs 5 in front of the toe clamps 13 whose base plates 14 fit snugly in the notches 7 so that these clamps 13 are received in the cutouts 6.

The converter 1 is held in place simply by fitting the ski boots 17 to the toe clamp 13 and to the standard heel clamp 18, which effectively clamps the converter 1 down on the skis 12. Spacer blocks 19 (FIGS. 4 and 6) can be provided on the rear tabs 8 to ensure that the converter 1 is indeed tightly engaged between the soles of the boots 17 and the top surfaces of the skis 12.

Figure 6:
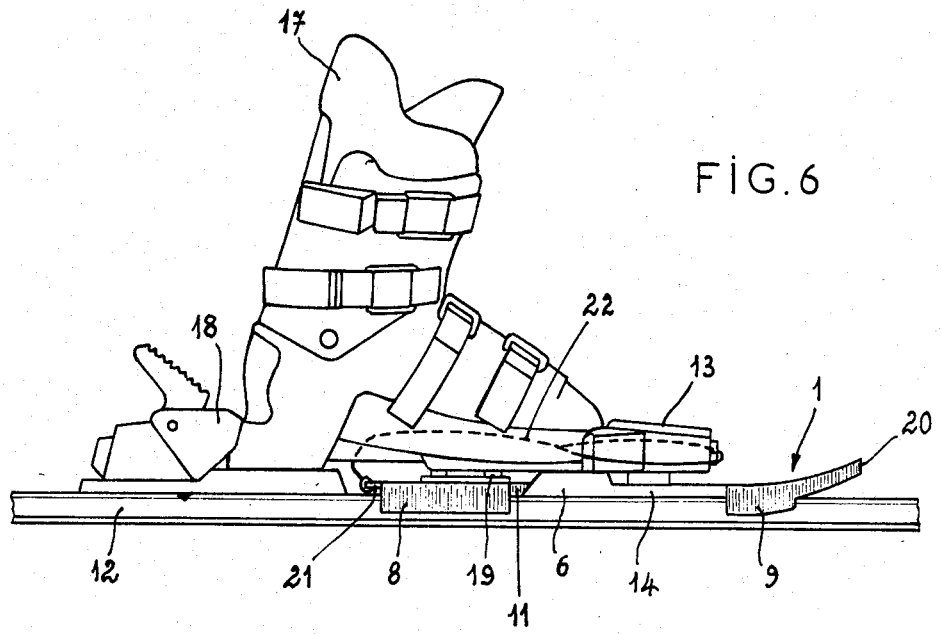
FIG. 6 is a side view showing the mounted converter and ski boot.
Figure 7:
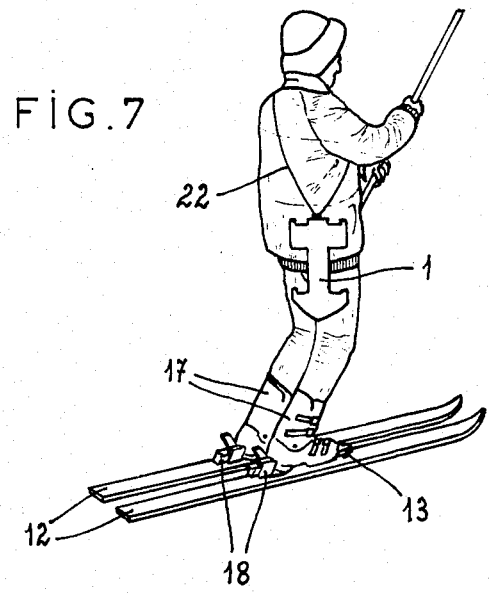
FIG. 7 is a small-scale perspective view illustrating how the converter is carried when not in use.

The front end of the converter 1 is forwardly convex and has a raised ski-like tip 20. In addition the rear end is formed with a central eye 21 to which is attached a lanyard 22. When in use the lanyard 22 is secured as shown in FIG. 6 to one of the toe clamps 13, and when not in use it can be slung over the user's shoulder as shown in FIG. 7 for easy carrying.

The converter according to this invention therefore makes it fairly easy to convert a standard pair of downhill skis into a monoski suitable for use on extremely powdery snow. The converter 1 itself is a very simple and inexpensive item that allows a skier to experiment with a monoski with little equipment cost and without making any changes to his or her existing skis. The device is small enough to carry in a knapsack or suitcase.

I claim:

1. In combination with a pair of skis each having an upper surface provided with a toe clamp and a heel clamp and respective ski boots securable by the clamps to the upper surfaces of the skis, a monoski converter having a rigid longitudinal stem having a front end and a rear end, the latter being integrally formed with respective rigid transversely projecting rear tabs, the tabs and stem forming a pair of like parallel seats that extend longitudinally and that are dimensioned to fit over the respective skis with the rear tabs on the respective upper surfaces between the respective toe and heel clamps, the ski boots being fitted to the clamps of the respective skis over the respective rear tabs with same pressed tightly directly by the boots against the upper surfaces of the respective skis, whereby the two skis are locked together against substantial movement relative to the boots into a monoski.

2. The combination defined in claim 1 wherein the converter is substantially symmetrical about a longitudinal central plane extending along the stem.

3. The combination defined in claim 1 wherein the tabs have longitudinal outer edges formed with longitudinal and downwardly projecting ribs delimiting the respective seats.

4. The combination defined in claim 3 wherein the converter is substantially thicker at the stem than at the tabs and the stem projects downward past the tabs and has longitudinal side edges laterally confronting the respective ribs and also delimiting the respective seats.

5. The combination defined in claim 4, further comprising spacers releasably secured to the longitudinal side edges and transversely engaging the respective skis, whereby skis of different width can be fitted tightly in the seats with the help of the spacers.

6. The combination defined in claim 1, further comprising spacer blocks secured to the rear tabs and held thereagainst by the respective ski boot.

7. The combination defined in claim 1 wherein the converter is provided with a lanyard.

8. The combination defined in claim 7 wherein the rear end of the stem is provided with an eye to which the lanyard is attached.

9. The combination defined in claim 1 wherein the tabs and stem are integrally formed of a rigid synthetic resin.

10. In combination with a pair of skis each provided with a toe clamp and a heel clamp and respective ski boots securable by the clamps to the skis, a monoski converter having a longitudinal stem having a front end and a rear end, the latter being formed with respective transversely projecting rear tabs, the converter being formed ahead of each rear tab with a transversely projecting front tab forming with the respective rear tab a laterally open cutout, the tabs and stem forming a pair of like parallel seats that extend longitudinally and that are dimensioned to fit over the respective skis with the rear tabs between the respective toe and heel clamps and the toe clamp engaged in the cutout, the ski boots being fitted to the clamps of the respective skis with the respective rear tabs held tightly between the boots and the skis, whereby the two skis are locked together into a monoski.

11. The combination defined in claim 10 wherein the front end of the stem is turned up.

12. The combination defined in claim 10 wherein each front tab is formed with a rearwardly and longitudinally open notch snugly receiving the respective toe clamp.

13. In combination with a pair of skis each provided with a toe clamp and a heel clamp and respective ski boots securable by the clamps to the skis, a monoski converter having a longitudinal stem having a front end and a rear end, the latter being formed with respective transversely projecting rear tabs, the converter being substantially thicker at the stem than at the tabs, the tabs having longitudinal outer edged formed with longitudinal and downwardly projecting ribs, the stem projecting downward past the tabs and having longitudinal side edges transversely confronting the respective ribs, the ribs, tabs, and side edges of the stem forming a pair of like parallel seats that extend longitudinally and that are dimensioned to fit over the respective skis with the rear tabs between the respective toe and heel clamps, the ski boots being fitted to the clamps of the respective skis with the respective rear tabs held tightly between the boots and the skis, whereby the two skis are locked together into a monoski; and spacers releasably secured to the longitudinal side edges and transversely engaging the respective skis, whereby skis of different width can be fitted tightly in the seats with the help of the spacers, the side edges of the stem being formed with holes and the spacers having lugs snugly fitting therein.

* * * * *